US007399148B2

(12) United States Patent
Bruun

(10) Patent No.: US 7,399,148 B2
(45) Date of Patent: Jul. 15, 2008

(54) FASTENING DEVICE FOR SECURING A CONTAINER TO A SHIP

(76) Inventor: Kent R. H. Bruun, Ebberupvej 5, Glamsbjerg (DK)

( * ) Notice: Subject to any disclaimer, the term of this patent is extended or adjusted under 35 U.S.C. 154(b) by 180 days.

(21) Appl. No.: 10/536,799

(22) PCT Filed: Nov. 26, 2003

(86) PCT No.: PCT/EP03/13297

§ 371 (c)(1),
(2), (4) Date: Sep. 14, 2005

(87) PCT Pub. No.: WO2004/048190

PCT Pub. Date: Jun. 10, 2004

(65) Prior Publication Data

US 2006/0088394 A1 Apr. 27, 2006

(30) Foreign Application Priority Data

Nov. 28, 2002 (DK) ..... 2002 01841

(51) Int. Cl.
*B60P 7/08* (2006.01)

(52) U.S. Cl. ..... 410/85

(58) Field of Classification Search ..... 410/85, 410/77, 101, 106
See application file for complete search history.

(56) References Cited

U.S. PATENT DOCUMENTS 4,252,456 A 2/1981 Kallaes et al.
5,143,010 A 9/1992 Behr et al.
6,666,633 B2 * 12/2003 Hsieh ..... 410/85
6,666,634 B1 * 12/2003 Hsieh ..... 410/85
7,014,399 B1 * 3/2006 Hsieh ..... 410/85
7,219,951 B2 * 5/2007 Rasmussen ..... 296/156

FOREIGN PATENT DOCUMENTS

DE 1005887 7/2001
GB 2106607 4/1983

OTHER PUBLICATIONS

International Search Report dated Apr. 26, 2004 for PCT/EP2003/013297.

* cited by examiner

*Primary Examiner*—H. Gutman
(74) *Attorney, Agent, or Firm*—Peter B. Scull; Berenbaum, Weinshienk & Eason

(57) ABSTRACT

A fastening device for establishing a self-adjusting fastening connection between at least two elements. The fastening device includes a frame having at least one opening and a connection to one of the at least two elements. It includes a rod with corrugations, the rod being movable through the at least one opening and it includes a connection to one of the at least two elements and a holding device including at least two locking elements, each locking element including at least one surface including dents/grooves corresponding to the corrugations. The frame or the holding device includes an at least partly tapered shape, and an elastic mechanism forcing the holding device against the frame and thereby the locking elements against each other. A method of establishing a fastening connection between at least two elements with a fastening device is also included.

24 Claims, 12 Drawing Sheets

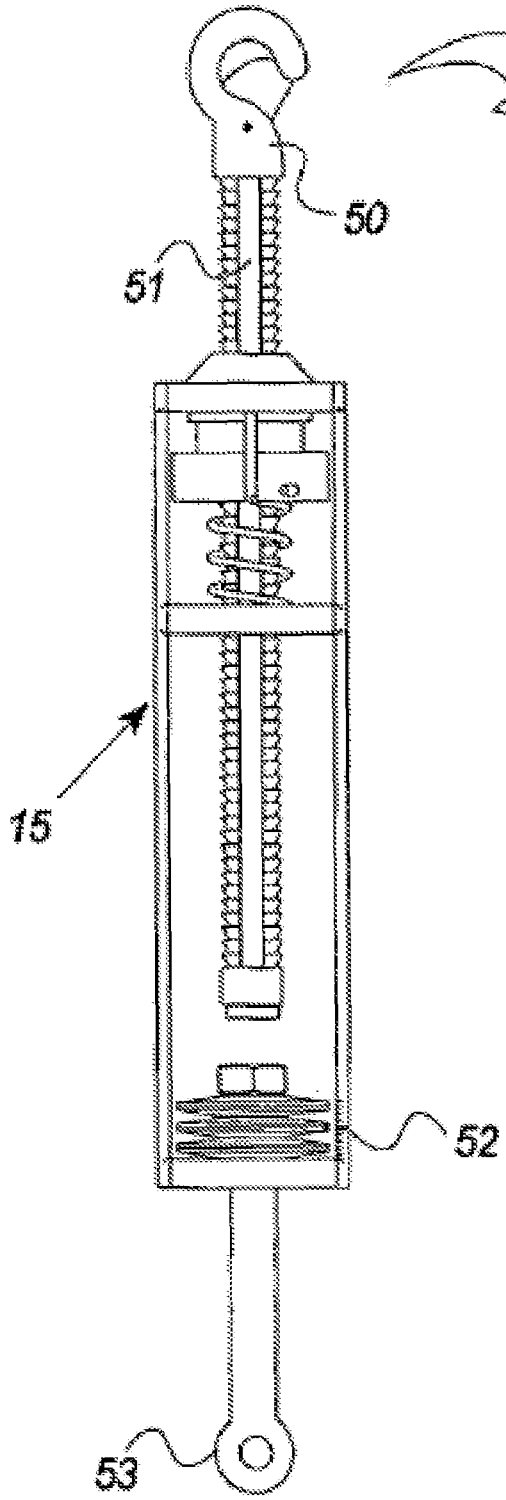
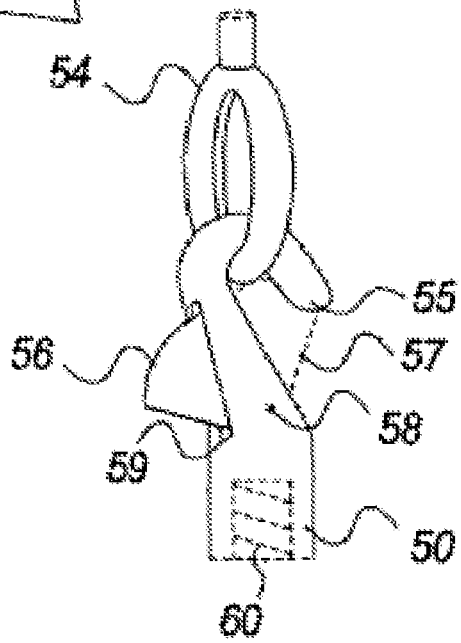
Fig. 9b
Fig. 9a

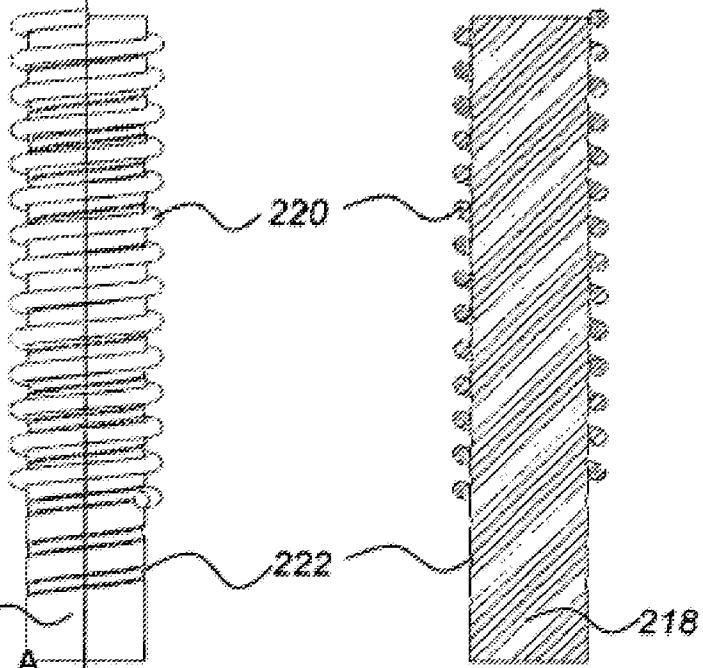
Fig. 13A
Fig. 13
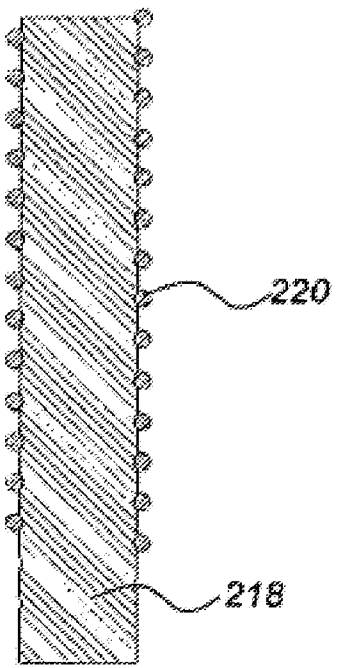
Fig. 12A
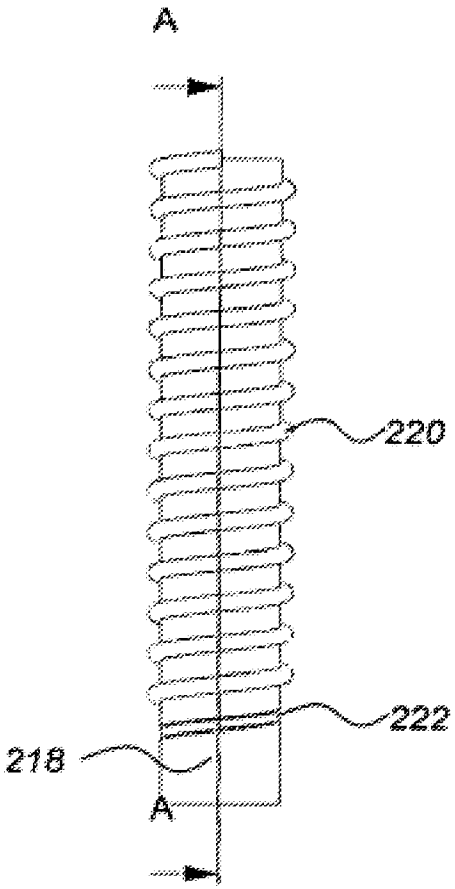
Fig. 12

FASTENING DEVICE FOR SECURING A CONTAINER TO A SHIP

CROSS REFERENCE TO RELATED APPLICATIONS

This application is the National Phase application of International Application No. PCT/EP2003/013297 filed Nov. 26, 2003, which designated the United States and was published in English. The International application, in its entirety, is incorporated herein by reference.

BACKGROUND OF THE INVENTION

The present invention relates to a fastening device and assembly for establishing a fastening connection between a container and a ship and to a method of establishing a fastening connection between a container and a ship.

Shipping is an example of an area in which fixation and retaining of objects is very relevant. Especially, as transportation by ship usually requires more substantial fixation in order to retain the objects in place e.g. during frequently changing weather conditions. Various methods and devices have been suggested in order to secure the objects, such as containerized cargo, to the deck of a ship e.g. a containership.

FIGS. 1*a* and 1*b* illustrate a common example of a modern containership seen from above and from the side, respectively. The containership comprises a number of containers located on the ship deck as well as below deck (not illustrated on the figures). To facilitate the carriage of a significant amount of containers the containers are closely stacked on deck in a height of several containers e.g. four containers on top of each other and four columns of containers across the ship deck as illustrated in FIG. 2*a*.

Once the containership is at sea, the containership's pitching, yawing and particularly its rolling affects the container stacks. Especially, if the containership encounters heavy weather, it may experience rolls of as much as 30 degrees from vertical. The rolling of the containership requires that the fixation is continuously adjusted in order to keep it tight and thus the containers secure on deck.

FIG. 2*a* further illustrates that space may be present between the top and bottom of the stacked containers e.g. due to pebbles, dirt or local unevenness of the containers. Upon the influence of the load, the ship's pitching, yawing and rolling motion and vibrations, the pebbles, dirt etc. may give way and the containers move closer together after some time, and thus the fixation needs to be readjusted to keep it tight.

FIG. 2*b* illustrates a well-known system of fixating and lashing containers to the deck or the hatch cover of a containership. The system comprises rods set up in traverse patterns over the faces of the containers and when containers are stacked, e.g. four or more high, double-height crosses that span two layers are superimposed on a bottom row of single-height crosses. The containers are also held together with twistlocks engaging with the top and bottom corners of containers positioned on top of each other. The twistlocks ensure that the upper container layers, which are not lashed by the system, stay in place.

A turnbuckle is provided for each rod to provide a manually adjustable connection to the deck of the ship. The tightening of the rods is performed from deck level by a ship worker or assistant equipped with a turnbuckle spanner or a similar handling tool.

The spanner is used to engage and turn the body of the turnbuckle in a left or right direction, whereby the left and the right screw threaded rod ends in the turnbuckle are turned closer or further apart.

A modern containership often carries thousands of containers on deck. A problem is the lashing of the deck containers since it involves numerous turnbuckles which all must be tightened during loading at port, frequently at sea in order to secure the container cargo from going overboard and releasing during unloading at port. The turnbuckles often weigh between 10 and 25 kilograms. The workers thus carry a significant weight load at the lashing. After establishment of the lashing the workers are facing the demanding task of tightening the thousands of turnbuckles with turnbuckle spanners. The tightening of the turnbuckles must be performed in all kinds of weather and often under very cramped conditions, as the containers are stacked very close to each other.

The tightening of the turnbuckles requires much man power and is obviously very time consuming, which is especially disadvantageous at port as many efforts have been made by the owners of the containerships to minimize the time the ships are at port. The lashing is thus very costly in time and money for the companies that operate the containerships.

SUMMARY OF THE INVENTION

The object of the invention is to create a fastening device that allows the containers to be lashed and unlashed rapidly, and is self-adjusting.

This object is achieved by providing a fastening device for lashing a load, in particular a container to a ship, comprising a frame having at least one opening and means for connecting to either the ship or the container, a rod with corrugations, the rod member received in and movable through the at least one opening and including means for connecting to either the ship or the container, a holding device comprising at least two locking elements, each locking element including at least one surface comprising dents/grooves partly or totally corresponding to the corrugations, at least the frame or the holding device being provided with an at least partly tapered shape, and resilient means urging the holding device towards the frame and thereby the locking elements towards each other.

Hereby, it is possible to create a secure fastening in a faster and easier way.

It shall be emphasized that the elastic means of the fastening device may be any suitable elastic or bouncing means such as any type of springs, rubber, hydraulic or pneumatic means such as shock absorbers.

When the fastening device includes a second rod with shock absorbing spring means such as a number of plate springs forced against the frame, it is possible to absorb brief shock forces transmitted to the fastening device from the secured elements.

Hereby the stress, which is put on the fastening device and the rest of the fastening system, is significantly reduced. Further, the need for tightening the fastening device is also reduced as the brief forces are not fully transmitted to the fastening system as such and thus cannot create slack in the system.

The shock absorbing spring means may be replaced by hydraulic or pneumatic suspension means.

When the frame comprises two longitudinal frame walls connected in an upper end by a transverse wall comprising contact surface for the holding device, in the lower end by a second transverse wall comprising contact surface for the shock absorbing spring means and in between by a third transverse section comprising contact surface for the spring means forcing the holding device against the contact surface of the frame, it is possible to create a very rigid fastening device.

The more rigid fastening device allows the frame construction to be lighter than normal. With the lighter frame construction the industrial injuries to the workers are minimized as they carry less weight during a workday.

When the holding device includes release spring means in between the surfaces comprising dents/grooves, it is possible to force the locking elements from each other if the parts are not held in place by the frame.

Hereby, a ratchet effect is achieved when the rod encounters a downward force. The effect allows the rod to move to a lower level and thus an automatic tightening of the fastening device is achieved.

As the fastening device tights itself during normal use, the risk of industrial injuries to the workers is minimized since less tightening has to be done manually.

When the frame and/or the holding device comprise a substantially conical, frustoconical, triangular, pyramidical or a similar tapered shape, a secure hold on the rod may be established. By forcing the tapered shapes on the frame and/or the holding device against each other the holding device is also forced against the rod: The more they are forced against each other the stronger is the hold on the rod.

It should be emphasized that the frame may comprise a non-tapered shape if the holding device comprises a tapered shape and vice versa e.g. a longitudinal opening in the frame. The tapered shape of the holding device may then be forced against the edges of the longitudinal opening and thus against the rod.

When the dents/grooves of the surface are reversed frustoconical shaped and/or the rod with corrugations comprises reversed frustoconical sections establishing the corrugations, it is possible to create a secure hold on the rod with the locking elements due to the large transverse attack surfaces on the rod and the dents/grooves.

When the rod and/or the holding device comprise contact surfaces for handling tools, an advantageous embodiment of the invention has been achieved.

The manual tightening or releasing of the fastening device may be performed by applying a force with the handling tool engaging the contact surface on the fastening device. The force is directed up or down with the handling tool thereby reducing the risk of industrial injuries to the workers further as rotating movements are avoided in the tightening or releasing process.

The tightening or releasing process in connection with the fastening device is also less time consuming as it involves one continuous movement instead of several rotating movements.

This means that fewer workers are needed to lash the cargo at port and sea

The continuous movement also means that lubricant is not necessary or may be reduced in contrast to systems involving rotating movements.

When the spring means is a helical spring, a uniform pressure may be established on the locking elements. Hereby, it is possible to hold the locking elements against corrugated rod with a uniform pressure and thus not forcing the rod to one side.

When use of a fastening device and method of establishing a fastening connection between at least two elements in relation with fastening of cargo such as lashing of shipping containers, a preferred embodiment is achieved.

It is another object of the preset invention to provide an assembly that allows containers to be lashed and unlashed rapidly whilst the assembly also being self-adjusting.

This object is achieved by providing an assembly for securing a container to a ship comprising: a lashing bar connected at one end to the container and at the other end to the first part of a fastening device, the fastening device comprises a second part connected to the ship, the first part and second part being movable relative to one another in the longitudinal direction of the lashing rod, and the fastening device comprises locking means that allow the first and second parts to move substantially unhindered towards one another whilst preventing the first and second parts from moving away from one another.

By using the fastening devices in relation to fastening of cargo on ships it is possible to minimize the time that is used on deck fastening and subsequently refastening the devices, as they are self-tightening. This involves a number of economical advantages to the shipping company.

Further, by reducing the time spent on deck the number of accidents may also be reduced.

Further objects, features, advantages and properties of the fastening device and assembly use thereof and methods according to the invention will become apparent from the detailed description.

BRIEF DESCRIPTION OF THE FIGURES

The invention will be described in the following with reference to the figures, in which:

FIGS. 9*a* and 9*b* illustrate variations of the fastening device according to the first embodiment, FIGS. 12 to 13A illustrate a third preferred embodiment of the fastening device according to the invention.

DETAILED DESCRIPTION

Figure 1A:
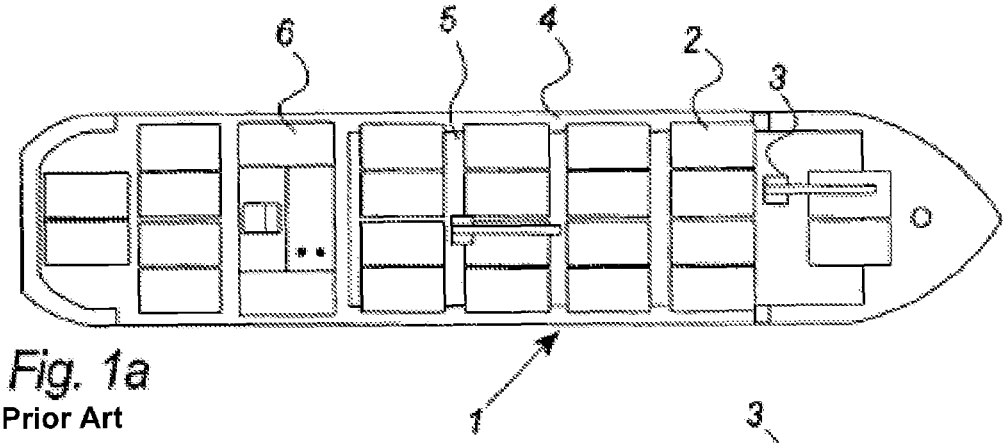
Fig. 1a Prior Art
FIGS. 1*a* and 1*b* illustrate a modem containership seen from above and from the side.
Figure 1B:
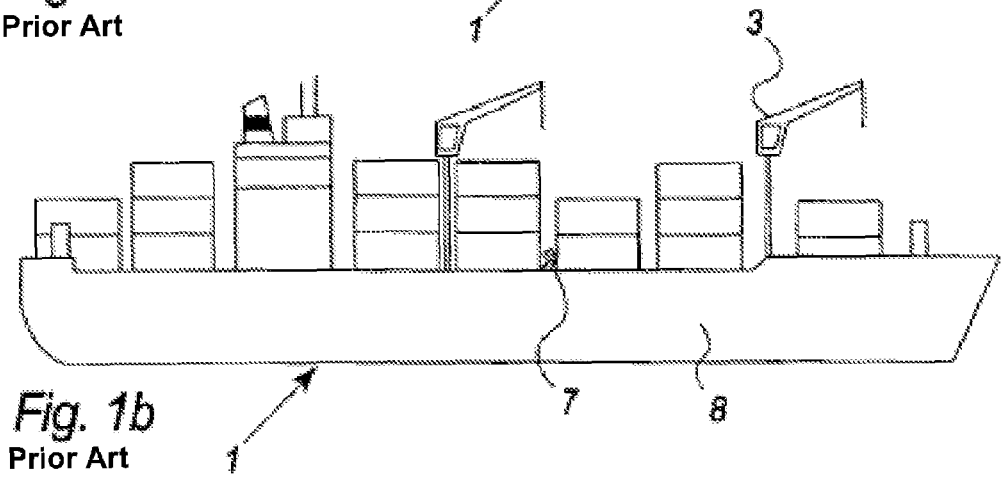
Fig. 1b Prior Art

FIGS. 1*a* and 1*b* illustrate an example of a modem multipurpose containership 1 with a number of shipping containers 2 located on the ship deck as well as below the ship deck 4 (not illustrated on the figures). The ship is further illustrated with a ship bridge 6 and a number of ship cranes 3 used to load and unload the containers 2.

The shipping containers are metal boxes used for the carriage of almost any type of cargo. Usual dimensions are 20.times.8.times.8.5 feet or 40.times.8.times.8.5 feet. The containers stored below deck in the containership's hull 8 may be held in place entirely by built-in "cell structures". The containers located on deck require lashing systems that secure the containers 2 to the ship deck 4 or to the ship hatches 5.

If the containers are stacked only two containers high, locking cones may be used as the only fastener device. The locking cones fit into receptacles at the corners of the containers, attaching each container to the deck or to the container right below. The cones generally have a twist-lock to resist the above-mentioned upward and sideways thrusts.

Figure 2A:
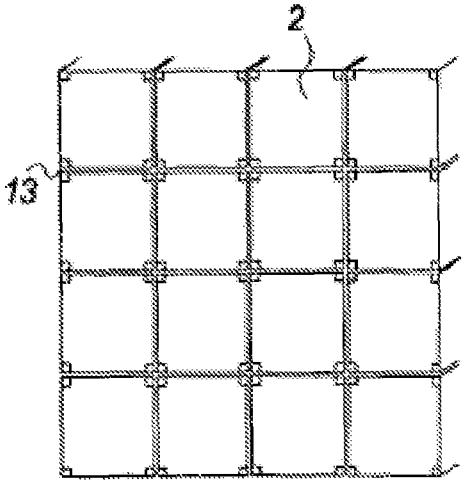
Fig. 2a Prior Art
FIG. 2*a* illustrates a section of containers stacked before lashing.

FIG. 2*a* illustrates a section of containers in which the containers are stacks of four containers on top of each other and in four stacks. In order to secure the section of containers to a ship's deck a lashing system has to be added.

FIG. 2*a* further illustrates that space 13 may be present between the top and bottom of the stacked containers 2 e.g. due to pebbles, dirt or local unevenness of the containers.

Figure 2B:
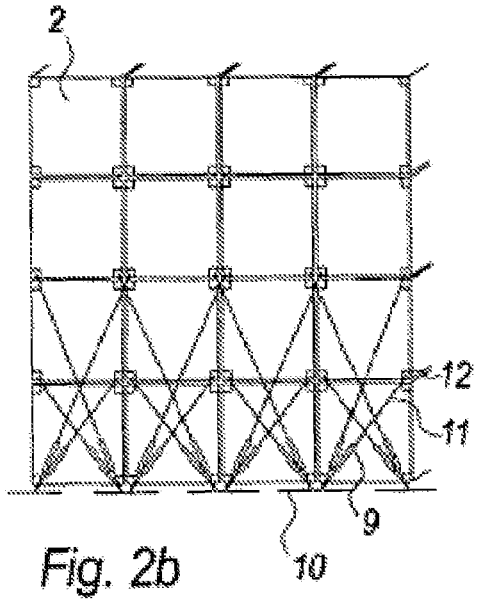
Fig. 2b Prior Art
FIG. 2*b* illustrates a well-known system of lashing a section of containers to the deck or hatch cover of a containership.

FIG. 2*b* illustrates the section of containers from FIG. 2*a* with the added lashing system.

The system is set up in traverse patterns over the faces of the containers and when containers are stacked, e.g. four or more high, double-height crosses that span two layers are superimposed on a bottom row of single-height crosses.

The system comprises turnbuckles 9 in which each turnbuckle is a link or sleeve with an internal screw thread at each end, one right handed and the other left handed. The turnbuckle functions as a means of uniting or coupling and of tightening two parts at the ends of two rods. One rod is connected to a tightening rod, chain or wire lashing 11 and the other to an anchoring point 10 on the ship deck or hatch. The tightening rod is in its opposite end connected to a securing pad 12 that fits into receptacles at the corners of the containers.

A ship worker or assistant 7 equipped with a turnbuckle spanner or a similar handling tool may perform the tightening of the turnbuckles from deck level. The spanner is used to engage and turn the link or sleeve of the turnbuckle in a left or right direction whereby the left and the right screw threaded rods in the turnbuckle are turned closer or further apart.

Figure 3A:
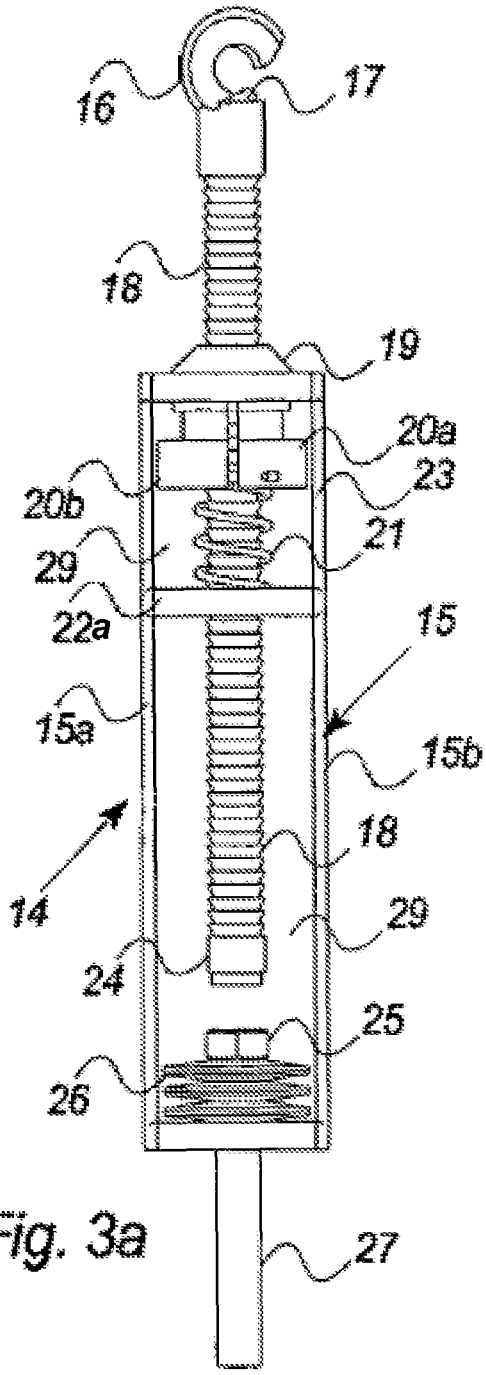
FIGS. 3*a* to 3*c* illustrate a first preferred embodiment of a fastening device according to the invention in a front view, a side view and a top view.

FIG. 3*a* illustrates a preferred embodiment of a fastening device 14 according to the invention in a front and upright view. The fastening device comprises a frame 15 with two longitudinal slot openings dividing the frame into two frame walls or sections 15*a*, 15*b*. The frame further comprises internal openings at each end. A first internal opening is positioned in an internally tapered section 19 of the first end of the frame 15. A rod with corrugations 18 is received in the opening, the opening allowing the rod to move up and down inside the frame in the present view. The internal tapered section 19 of the first end of the frame 15 preferably has the shape of a cone or a frustocone pointing up against the first internal opening.

The rod 18 ends in a hook 16 with a locking bar 17, allowing the connection of the fastening device 14 through the hook to an eyelet of the lashing rod 11. After positioning the eyelet in the hook the locking bar 17 may be forced into a locked position e.g. by spring means and thus ensuring that the eyelet stays in place and the connection between the lashing rod 11 and the rod 18 becomes substantially rigid.

The rod 18 includes a number of corrugations in most of its longitudinal extension. Each of the corrugations is a triangular rim stretching out from the rod, the topside of the rim creating a substantially transverse surface or platform. Each of the corrugations may also be described as a reversed frustoconical section.

The rod 18 also includes an end stop 24 in the opposite end ensuring that the rod does not move out past a wall 22*a*. The wall 22*a* is a transverse plate with a central hole allowing the rod 18 to move until the end stop reaches the wall from beneath. The wall also connects the two frame sections 15*a*, 15*b* and works as a contact surface or backpressure wall for a helical spring 21. The spring is pressed up against the underside of a locking device 20 comprising two locking elements 20*a*, 20*b*.

The top of the locking elements together form the shape of a cone pointing upward and corresponding to the internal tapered section 19 of the first end of the frame 15. The two surfaces of the locking elements facing each other include dents/grooves corresponding to the corrugations of the rod (as further illustrated and explained in connection with FIGS. 4*b* and 5*b*).

As explained above, the helical spring 21 is pressed up against the underside of the locking device 20 comprising two locking elements 20*a*, 20*b*, and the conical top of the locking elements is thereby pushed into and against the tapered section 19 of the first end of the frame 15. Further, the two surfaces of the locking elements facing each other are forced against each other as the cone top engages the tapered section. Thus, the dents of the locking elements also engage with the corrugations of the rod and hold it in place.

The second internal opening is positioned in the opposite end of the frame 15 and allows a bolt 27, with a bolt head or an end nut 25 in one end, to enter and be retained in the frame. The other end may comprise a hook or an eyelet allowing the fastening device to be secured to another element or part such as a ship deck or ship hatch. Between the bolt head or end nut 25 and the frame a number of shock absorbing plate springs 26 are positioned, e.g. three plate springs. The plate springs preferably pressed against a contact surface on top of a transverse plate 22*b* with a central hole connecting the frame sections 15*a*, 15*b*. The hole allows the bolt 27 to move primarily under the restriction of the plate springs and the bolt head or end nut 25.

Figure 3B:
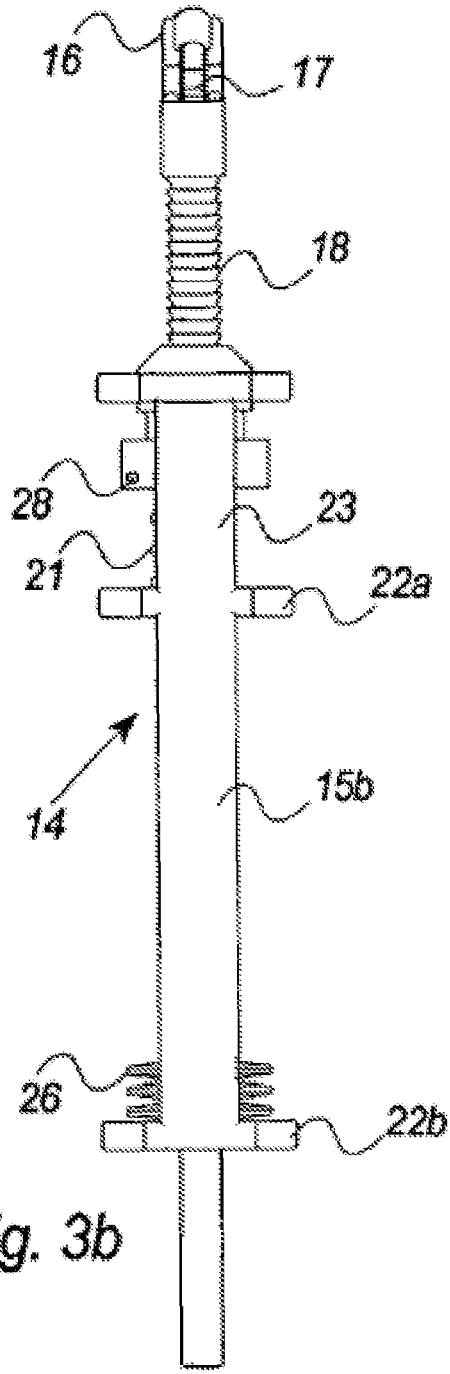

FIG. 3*b* illustrates the preferred embodiment of the fastening device 14 according to the invention in a side and upright view. The frame section 15*b* is illustrated as a single longitudinal plate connected with the other frame section 15*a* through the tapered section 19 and the transverse plates 22*a*, 22*b* creating a rigid frame structure for the fastening device 14.

Figure 3C:
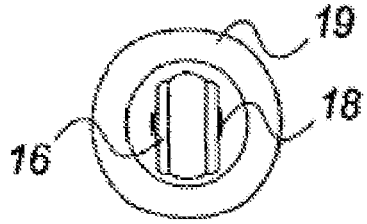

FIG. 3*c* illustrates the preferred embodiment of the fastening device 14 according to the invention seen from above. As seen in the figure the fastening device has a tubular shape with the rod 18 positioned in the center of the fastening device. The frame 15 and the locking device 20 may as mentioned above comprise a substantially conical or frustoconical shape. However, the shape may also be triangular, pyramidical or a similar tapered/frustum shape.

In a further embodiment of the invention only one of the frame 15 and the locking device 20 comprises a tapered shape, e.g. the locking device, while the frame internally has longitudinal walls that the tapered locking device is forced up against. The edges of the longitudinal walls will force the locking elements of the locking device against each other.

Figure 4A:
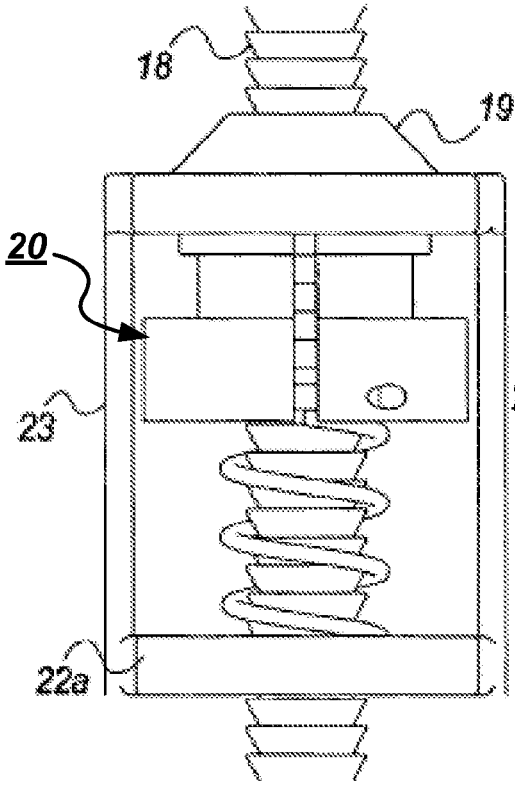
FIG. 4*a* illustrates a front view of a section of the fastening device according to the invention.

FIG. 4*a* illustrates a front view of a section of the fastening device according to the invention. The section includes the internal tapered section 19, the locking device 20 comprising the two locking elements 20*a*, 20*b*, a section of the rod 18 as well as the helical spring 21 and the transverse wall 22*a*. As it is seen in the figure each of the locking elements 20*a*, 20*b* substantially surrounds—from the side—half of a section of the rod 18.

Figure 4B:
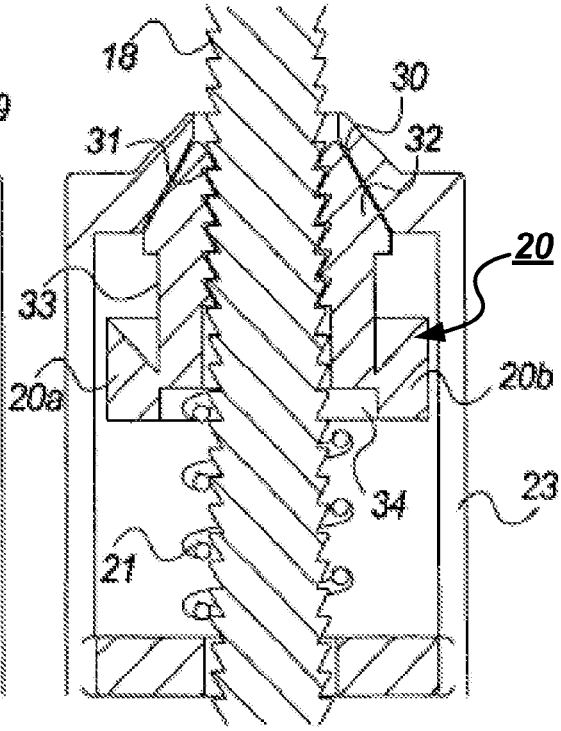
FIG. 4*b* illustrates a cross-section of the fastening device illustrated in FIG. 4*a*.

FIG. 4*b* illustrates a cross-section of the front view in FIG. 4*a*. The locking elements 20*a*, 20*b* are both illustrated with a top section 32 having a conical shape corresponding to the shape of the internal tapered section 19 of the frame 15. The top sections of the locking elements are cone halves that together substantially form a full cone. The cone halves are forced up against the internal tapered section 19 by the helical spring 21 and as a result of this the locking elements are also forced in an inward direction against each other and against the rod centred between them.

The surfaces facing the rod have a number of dents/grooves with a triangular cross-section reversely corresponding to the corrugations of the rod. With the underside of the triangular dents having a substantially transverse surface or platform, it is possible for the dent to engage closely and firmly with the corrugations of the rod as illustrated in the figure.

Beneath the conical top the locking elements comprises an area with a longitudinal contact surface 33. The longitudinal contact surface is limited at both ends by edges that stretch out allowing for a release and tightening handling tool to engage with the surface and at the same time push against one or both of the limiting edges.

Figure 8A:
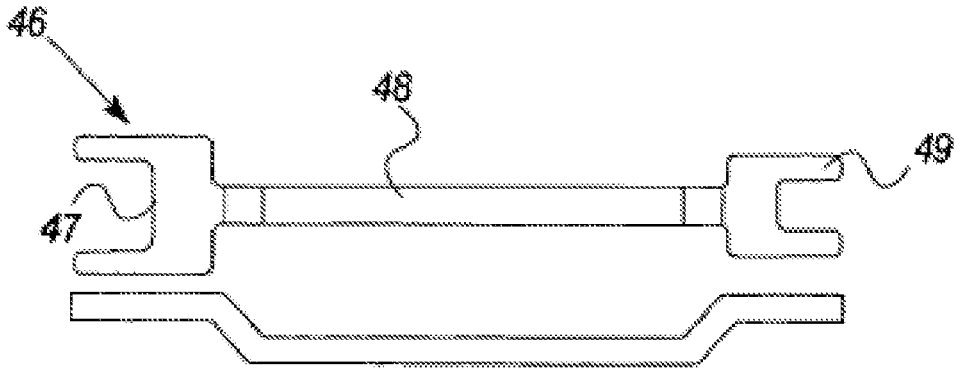
FIGS. 8*a* and 8*b* illustrate an embodiment of a handling tool and use thereof in connection with fastening device according to the invention.
Figure 8B:
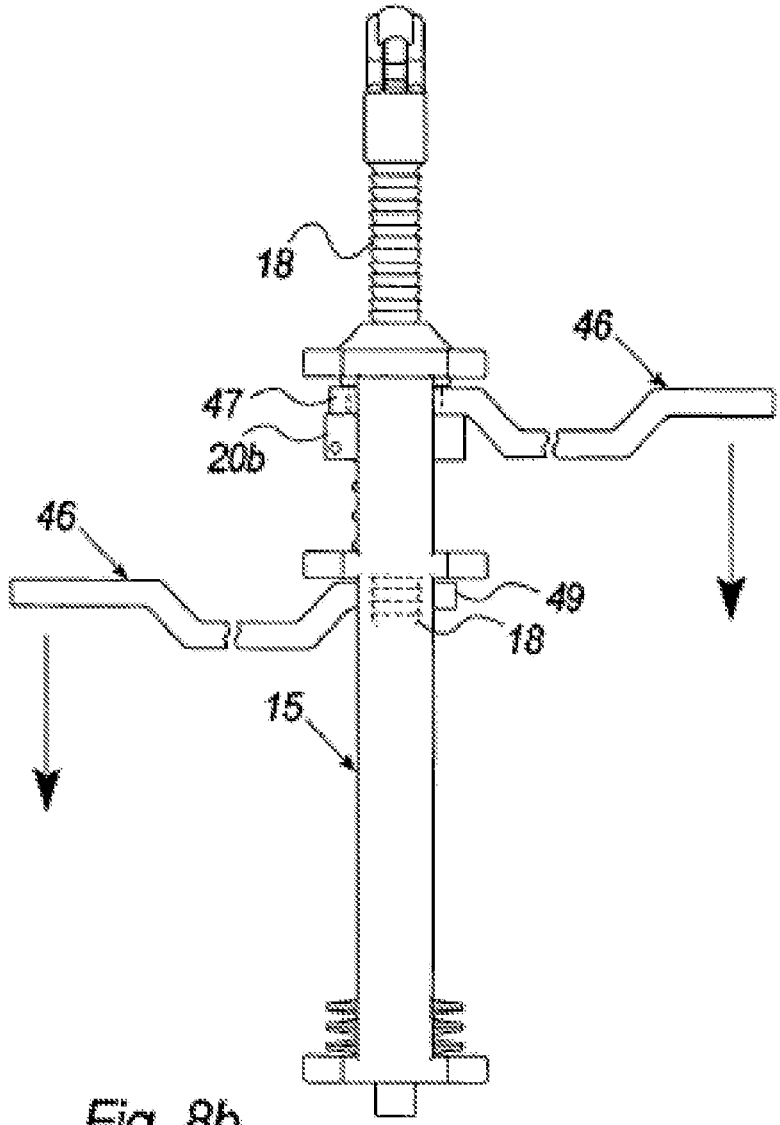

An example of a release and tightening tool and the functionality of the tool is illustrated in FIGS. 8*a* and 8*b* and described in details below.

As illustrated in FIGS. 4*a* and 4*b* the helical spring 21 is pressed against the wall 22*a* and against the locking elements 20*a*, 20*b*. In FIG. 4*b* it is further illustrated that the spring is held in place by dents 34 in the underside of the locking elements. The dents create a circular space for a top part of the spring and are only limited in outward direction by a vertical wall.

Figure 5A:
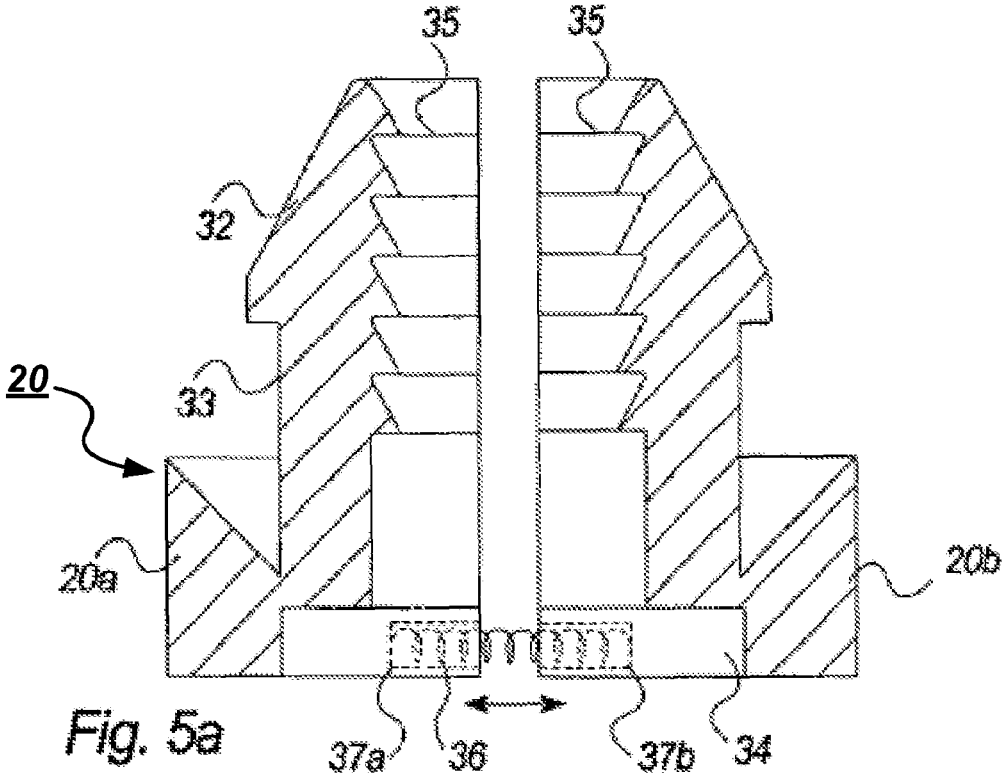
FIG. 5*a* illustrates a cross-section of the first and second locking elements of the invention.

FIG. 5*a* illustrates a cross section of the first and second locking element according to the invention. In the figure it is further illustrated with locking elements forming half parts to surround the rod with corrugations. Further, the triangular dents of the locking elements are illustrated in a way that clearly indicates how they reversely correspond to the corrugations of the rod. In order to facilitate the separation of the locking elements when they are forced out of the internal tapered section 19 of the frame, two release springs 36 are positioned in spring enclosure parts 37*a*, 37*b* of the lower part of the locking elements. The openings of the enclosures 37*a*, 37*b* are positioned in the surfaces of locking elements which face each other and close to the edge of the locking elements—preferably in or in proximity of the wall enclosing the dents 34 of the helical spring 21.

Figure 5B:
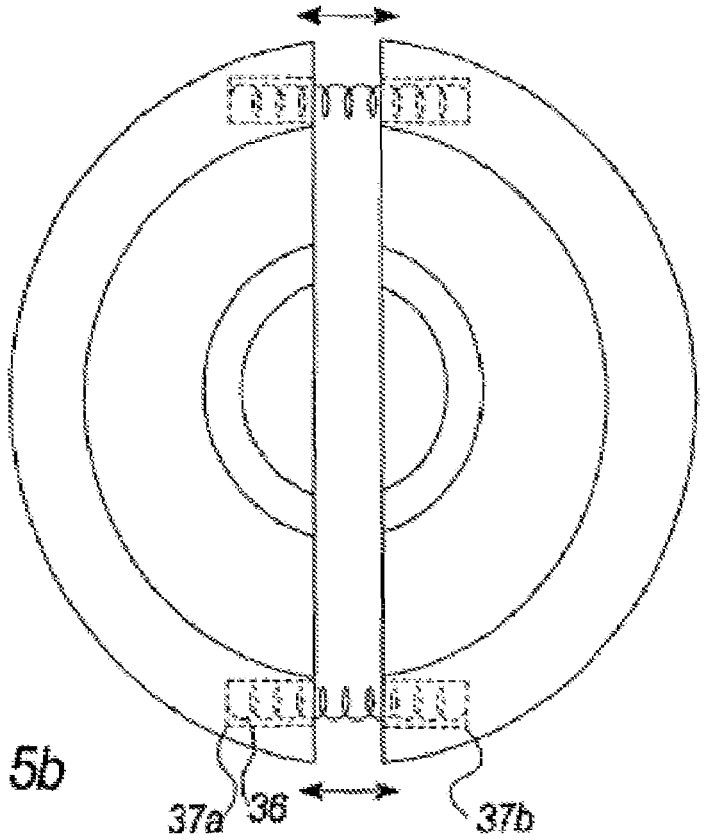
FIG. 5*b* illustrates the first and second locking elements of the invention seen from above.

FIG. 5*b* illustrates that each of the release springs 36 stretches from the first enclosure part 37*a* through the opening between the locking elements 20*a*, 20*b* and into the second enclosure part 37*b*.

The two figures further illustrate that the locking elements 20*a*, 20*b* are forced from each other at the lower ends. The separation allows the rod corrugations to disengage with the dents of the locking elements and thus move freely up and down. When the force is removed, the helical spring will once again force the locking elements against the internal tapered section and against the rod while squeezing the release springs together.

Figure 6:
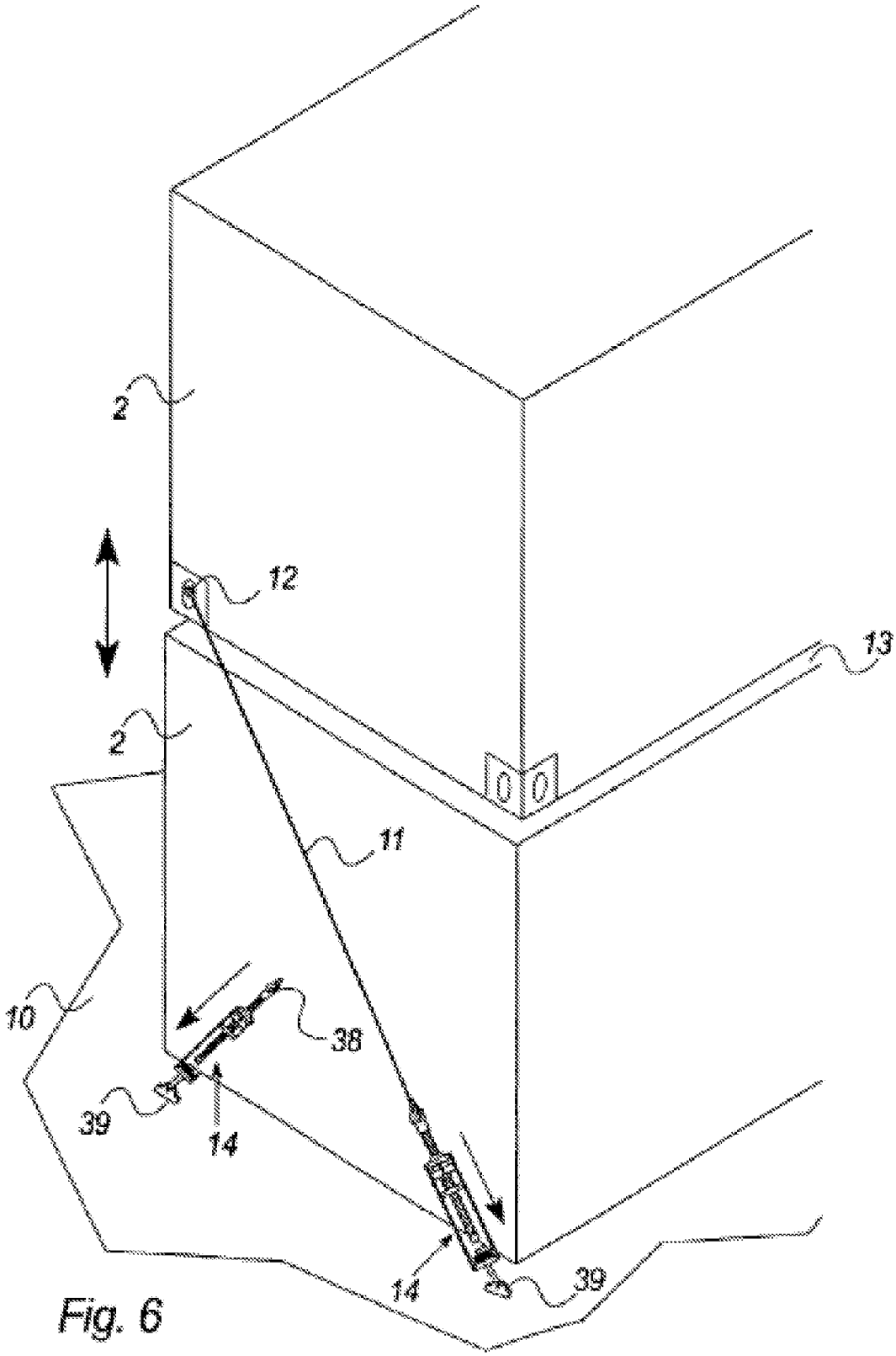
FIG. 6 illustrates a preferred embodiment of the fastening device according to the invention in a normal place of use, FIG. 7 schematically illustrates the functionality of the fastening device according to the invention at port and at sea.

FIG. 6 illustrates a preferred embodiment of a fastening device according to the invention in a normal place of use. The use involves a container ship deck or hatch 10 in which two containers 2 are positioned on top of each other.

The invention is a part of the lashing system, which is set up in traverse patterns over the faces of the containers from deck or hatch to the receptacles at the lower corners of the upper container. The lashing system also comprises lashing bars 38, securing pads 39, etc. as described above in connection with well-known lashing systems.

If the upper container tries to move away from the deck or hatch the lashing system will substantially retain it in its position as the fastening device only allows small movement upwards by squeezing the plate springs together. The rod with corrugations is held in place by the locking members. These are forced against the internal tapered section 19 of the frame 15 by the movement and thus held in place.

When the container returns to its normal position the plate springs will return to a non-actuated position. However, if the container is coming closer to the deck or the hatch, e.g. due to compression of pebbles, dirt or to absorption of local unevenness of the containers, the lashing bar will transfer the movement to the rod with corrugations. The rod will move downwards and push the locking elements 20*a*, 20*b* down. The locking elements will squeeze the helical spring together allowing the locking elements to ease their hold on the corrugations of the rod by moving away from each other. When the locking elements are sufficiently pulled apart the corrugations of the rod may be moved down through the dents of the holding devices as a kind of ratchet.

When the downward movement of the rod is stopped the helical spring 21 will once more urge the locking elements 20*a*, 20*b* towards the internal tapered section 19 and towards the rod. The rod will once again be held in place by the holding devices but in a lower position than before and the lashing system has been adjusted. The container is once more secured but in position closer to the deck or hatch.

Figure 7:
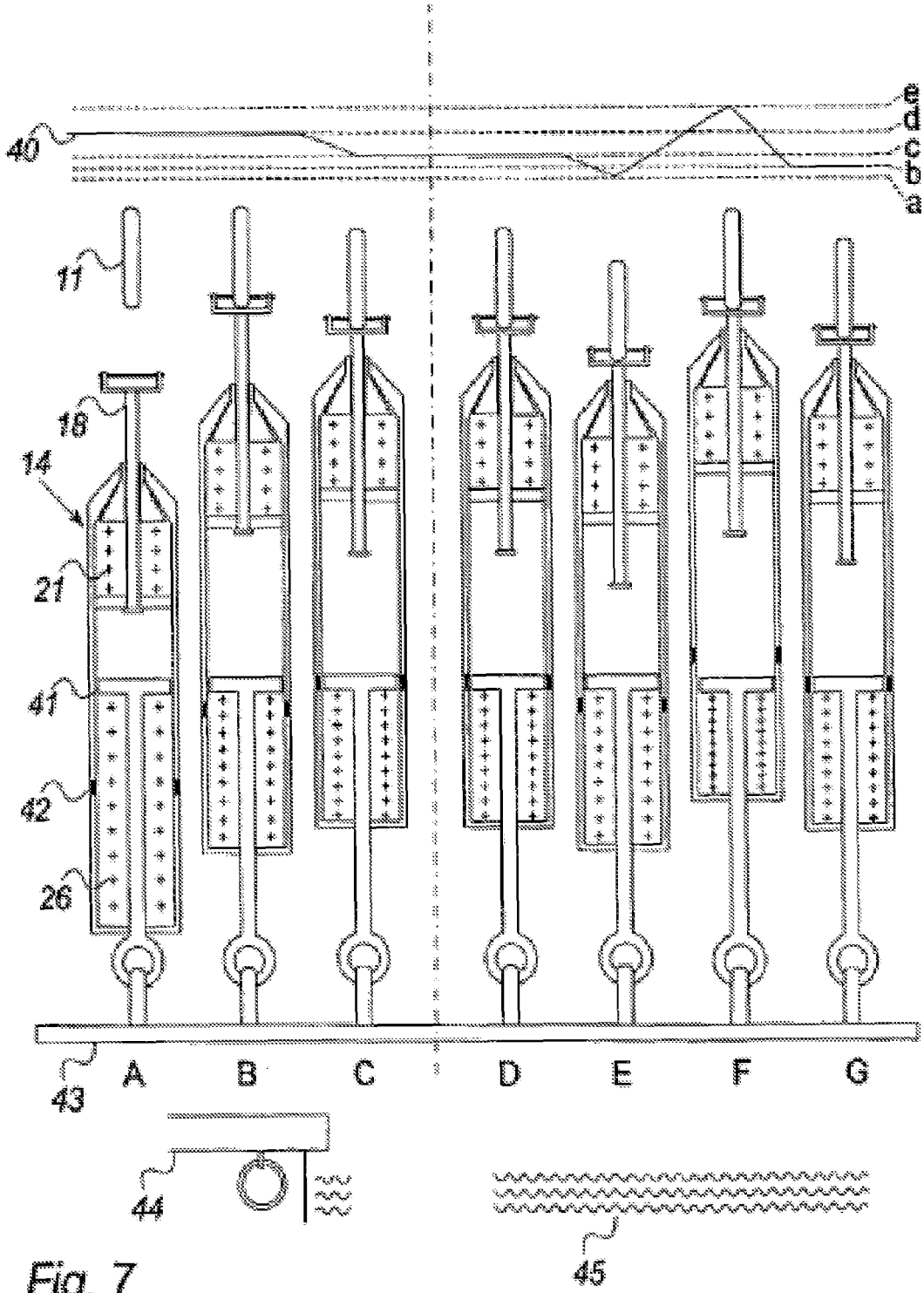

FIG. 7 schematically illustrates the functionality of a fastening device according to the invention at port and at sea. The fastening device may be a part of a container fastening system on a container ship.

The functionality is at port 44:

A) The fastening device 14 is connected to an anchor point in the ship deck, hatch or similar ground plane 43 by a spring actuated bolt 41. The spring-actuated bolt is illustrated with a schematic indication of a balance lever 41 moving in relation to a preferred balance position 42. The preferred position may be seen as a position in which the lashing system is tight without damaging the spring of the bolt.

In the present situation the bolt is pushed upward by the spring as the fastening system is connected to the deck or hatch but not yet to the rest of the lashing system (illustrated by the bar 11). The balance lever 41 is high above the preferred balance position 42.

B) The fastening device 14 is connected to the rest of the lashing system, represented by lashing rod 11 but not yet tightened. The rod with corrugations 18 is in its most extracted position whereas the bolt head 41 is beginning to squeeze the spring 26 together. The balance lever 41 is moving closer to the preferred balance position 42.

C) The lashing system is tightened by the handling tool forcing the rod downwards until the preferred position is reached. The balance lever 41 is levelled at the preferred balance position 42.

The functionality is at sea 45:

D) The container is secured and not moving. The fastening device is in a non-actuated situation. The balance lever 41 remains at the preferred balance position 42.

E) The container is coming closer to the ground plane 43 and the rod 18 is pushed downwards. The locking elements are forced apart allowing the parts to let go on the rod and thus the rod to move down to a lower position. The balance lever 41 moves slightly above the preferred balance position 42 absorbing a bit of the slack in the fastening system.

F) The container is trying to move up in relation to the ground plane 43 and the force is transferred to the rod. The rod tries to move but is held in place by the holding devices that are forced against the frame of the fastening device. The balance lever 41 moves slightly below the preferred balance position 42 absorbing the shock of the force.

G) The container has stopped moving. The fastening device is in a non-actuated situation. The balance lever 41 returns to the preferred balance position 42 but with the rod in a lower position.

The longitudinal motion behaviour of the fastening device is schematically indicated by the curve 40 in which it is seen that the fastening device at sea moves from a stable level "c" to a stable level "b" over temporary levels "a" and "e" when the container moves up and down or vice versa.

FIG. 8*a* illustrates an embodiment of a handling tool to be used in connection with a fastening device according to the invention. The handling tool 46 comprises a spanner with a tool shaft with offset jaw parts 47, 49 in each end. The two jaw parts are illustrated with different jaw sizes in order to engage both a release and a tightening section of the fastening device if these sections have different proportions. The release jaw 47 is illustrated with a larger jaw size compared with the size of the tightening jaw 49.

FIG. 8*b* illustrates the use of the handling tool 46 of FIG. 8*a* in connection with the fastening device 14 according to the invention. The handling tool is illustrated in a first and second position of use. In the first position the release jaw 47 engages with the contact surface 33 of one locking element 20*a* or both locking elements 20*a*, 20*b*. The other end of the handling tool is pushed down, e.g. by a ship worker, and hereby forcing the locking elements 20*a*, 20*b* downwards. As the locking elements are forced down their capability to engage with the corrugations of the rod is reduced until the rod is free to move e.g. upward. In a preferred embodiment the locking elements are forced apart by a spring e.g. as illustrated in FIGS. 5*a* and 5*b*.

In the second position the tightening jaw 49 engages with any of the corrugations, preferably just below wall 22*a* nut. By forcing the handling tool downwards it is possible to pull the rod and the handling devices downward. The arm of the tool may hereto be used as a lever that uses the edge of transverse wall 22*a* as a pivot point.

The corrugations of the rod are pulled down through the dents of the locking elements as a kind of ratchet. When the force from the handling tool is removed the rod is once again held by the locking elements and hereby securing that the rod cannot move upwards to the previous position.

FIG. 9*a* illustrates details and further variations of the fastening device according to the invention. The hook 50 of the rod includes a spring biased locking bar that is pivotally suspended by an axle 58. The locking bar is illustrated in a locked position in which an eyelet 54 of a lashing bar or wire is detained. The figure is illustrated with a rod having at least one longitudinally extending non-corrugated section 51 from end stop to hook. The section may be a slot pressed into the rod or a smooth strip stretching out and e.g. being in-line with or past the corrugations.

FIG. 9*b* illustrates a section of the further variations. The locking bar 56, 57 comprising a first section illustrated in a release position in which it is forced by pushing another section of the locking bar back and away from a hook ending 55. The locking bar 56, 57 pivots around an axle 58 in an opening 59 of the hook 50. The hook ending 55 has a slot, which the locking bar 57 enters when it is in a locked position (illustrated with dotted lines) detaining the eyelet of the lashing bar or wire 54. The figure further illustrates that the hook comprises an internal thread 60 that may be screwed onto a thread (not illustrated on the figures) on the rod with corrugations and thus securing the hook onto the rod.

In another variation the connection between the rod and a lashing bar may be established with a spigot-and-socket joint or a similar fixed connection between the rod and bar.

FIGS. 9*a* and 9*b* both illustrate that the locking bar has a rising shape toward the hook ending 55. When the locking bar is in a locked position the eyelet 54 may in some situations push downwards against locking bar. The push will force the locking bar against the hook ending 55 due to the shape and thus retaining the locking bar in the locked position instead of forcing it toward the release position.

Figure 10:
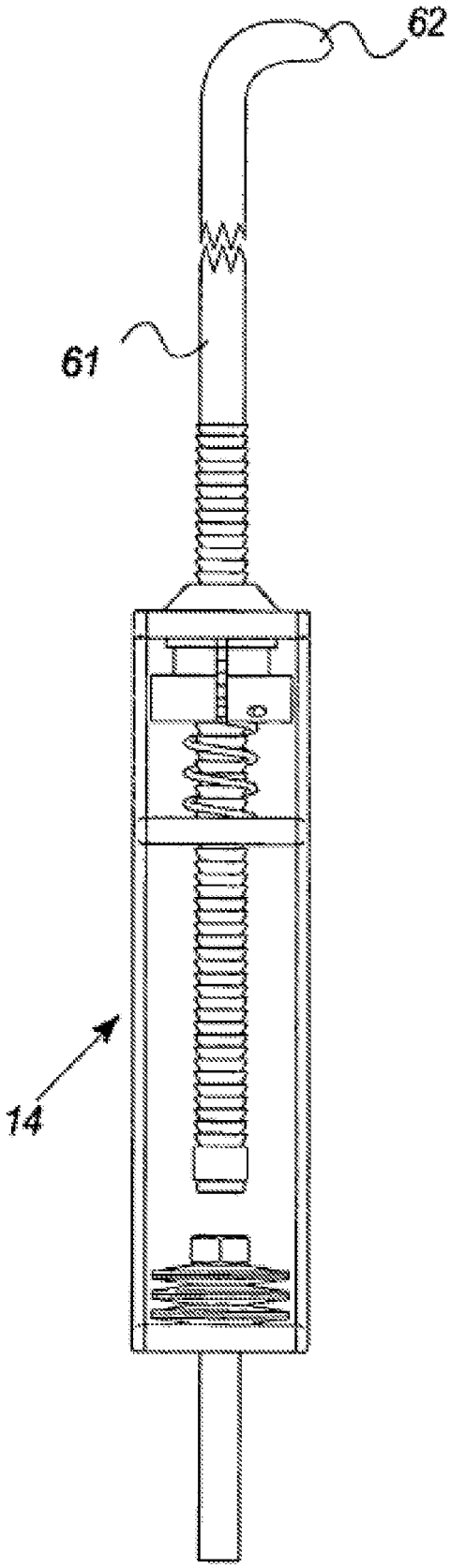
FIG. 10 illustrates a further variation of the fastening device according to the first embodiment.

FIG. 10 illustrates an even further variation of the fastening device according to the invention. The rod with corrugations has a first length but continues as a further rod 61 with a second length with a smooth surface and hereby establishing a combination including the rod with corrugations and a lashing bar ending in a hook 62 for opening in container corners. The combined rod is preferably made in one metal bar that subsequently is supplied with corrugations etcetera.

Figure 11:
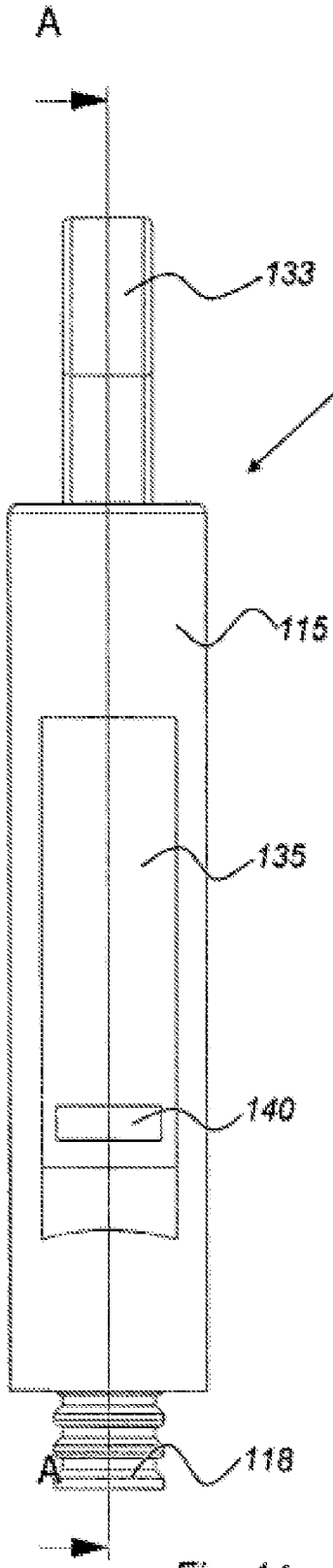
FIGS. 11 and 11A illustrate a second preferred embodiment of the fastening device according to the invention.
Figure 11A:
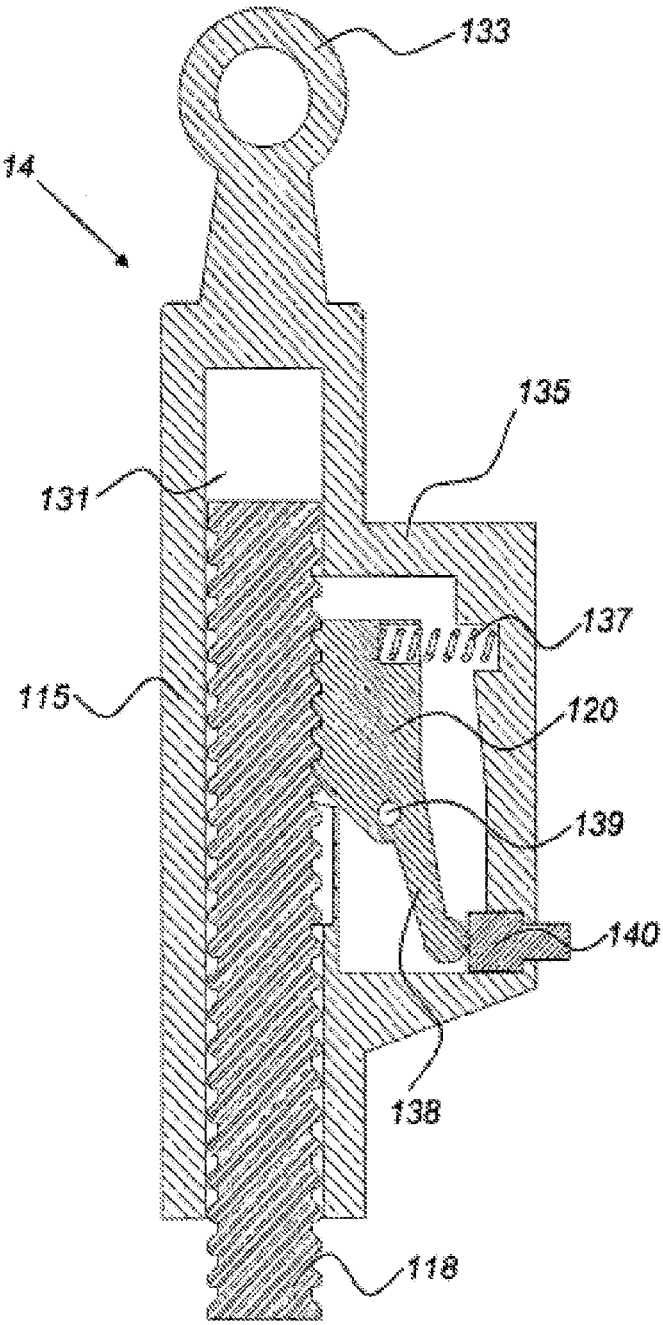

FIG. 11 illustrates a side view and FIG. 11A illustrates a cross-sectional view of a second preferred embodiment 114 of the invention. A rod 118 with corrugations is received in a substantially cylindrical recess 131 of a housing 115. The rod 118 is preferably rigidly connected to the lashing bar 11 (not shown). The housing 115 is provided with an eye 133 that is anchored to the deck of the ship. The housing is provided with a protrusion 135 defining a cavity in which a locking element 120 is received. The locking element is pivotally suspended from a pivot pin 139. One side of the locking element is provided with corrugations or teeth that match corrugations on rod 118. A helical spring 137 urges the locking element to engage the rod 118 with its teethed side.

The location of the pivot pin 139 and the contact angle of the teeth that engage the corrugations on the rod is selected such that the locking element is urged towards the rod when a force pulling the rod out of the housing is applied. The locking element is thus held in the locking position by a self-amplifying mechanism. The rod 118 can thus not be pulled out of the housing by the load.

On the other hand, the location of the pivot point and the angle of contact of the teeth that engage the corrugations on the rod is also selected such that the locking element is urged away from the rod to overcome the force applied by the spring 137 when a force pushing the rod into the housing is applied. The rod 118 can thus be substantially freely pushed into the housing to e.g. adjust for containers that are moving downwards, i.e. fall into place during the transport period.

The locking element is further provided with a rocker arm 138 that allows the locking element to be disengaged by pressing a button 140 that acts on the free end of the rocker arm. Thus, the rod can be pulled out freely when the button 140 is pressed for quick removal of the lashing during unloading of the containers at port.

FIG. 12 illustrates a side view and FIG. 12A illustrates a cross-sectional view of a third preferred embodiment of the invention. A cylindrical rod 218, preferably provided with a helical groove 222, is received in a substantially cylindrical recess (not shown) of a housing (not shown). The rod 218 is preferably rigidly connected to the lashing bar 11 (not shown). The housing is anchored to the deck of the ship.

The helical spring engages the cylindrical rod 218 then the rod is moved outwards, i.e. when a force is applied that pulls the lashing rod 11 away from the deck. When the cylindrical rod is pushed towards the deck, the helical spring 220 does not engage the cylindrical rod 218 and the cylindrical rod can move freely towards the deck. FIGS. 12 and 12A illustrate the helical spring in the engaged and locking position, whilst FIGS. 13 and 13A show the helical spring in the disengaged position.

Figure 14:
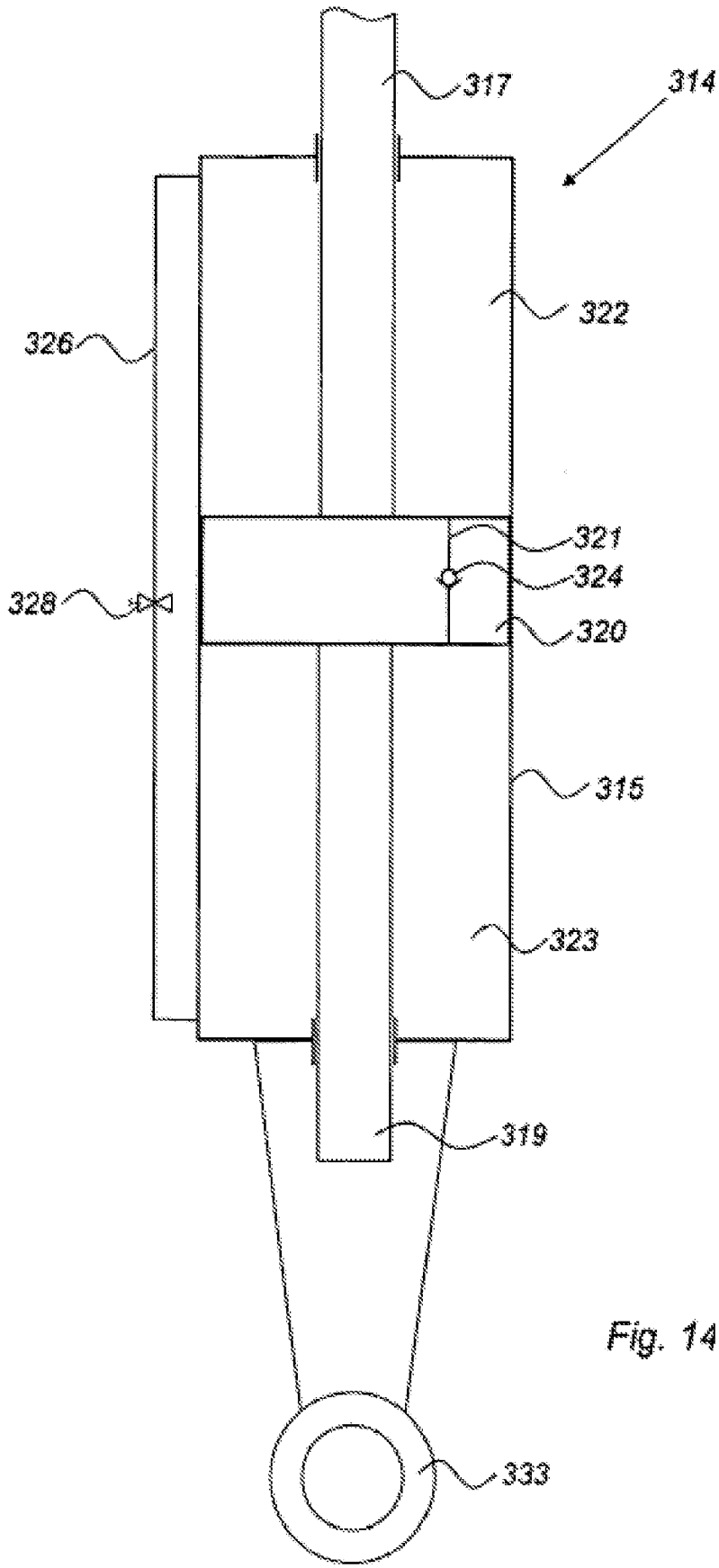
FIG. 14 illustrates a fourth preferred embodiment of the fastening device according to the invention.

FIG. 14 is a sectional view of a fourth preferred embodiment of the invention in which the fastening device comprises a hydraulic cylinder 314. The cylinder housing 315 is anchored to the deck of the ship via an eye 333. The piston rod 317 is rigidly connected to the lashing rod (not shown). A conduit 321 with a one way valve 324 extends through the piston 320. The one way valve allows the hydraulic fluid in chamber 323 to flow freely into chamber 322, but bars fluid in chamber 322 to flow to chamber 323. The second piston rod 319 ensures that the movement of the piston does not lead to a change in combined volume of hydraulic fluid in the chambers 322 and 323 when the piston moves.

When a force urging the piston into the cylinder is applied to the piston rod the fluid in chamber 323 flows to chamber 322 without great resistance. The piston rod can thus move substantially freely into the cylinder housing 315, when e.g. the container connected to the lashing rod 11 moves downward during the transport period.

When a force pulling the piston rod out of the cylinder is applied to the piston rod the fluid in chamber 322 is pressurized, but it cannot leave the chamber since the one-way valve 324 bars the fluid from flowing towards chamber 323. The piston rod can thus not move outwards, and the fastening device 314 holds the lashing rod 11 securely into place when a load is applied, e.g. by a rolling movement of the ship.

A conduit 326 with a preferably manually operated on/off valve 328 connects chamber 322 with 323. When the valve 328 is open the piston 320 can move freely in both directions and thus the piston rod 317 can be pulled out freely for quick removal of the lashing during unloading of the containers at port.

Most of the components in the fastening device are preferably made of metal such as steel, iron or aluminum. In some embodiments the fastening device may however also be constructed partly or totally in plastic materials or similar materials. If a higher degree of strength than possible with plastic materials is required, glass fibre materials or other fibrous enforced material such as coal fibre materials may be used.

The springs of the fastening device may be replaced with other elastic or bouncing means such as sections of rubber instead of the helical spring 21 or a hydraulic or pneumatic shock absorber instead of disk springs 26, 52.

The frame of the fastening device can be formed by two releasably connectable parts that can be connected to one another in different positions to regulate the length of the frame. This can e.g. be realized by two pairs of overlapping longitudinal frame members, one of the pairs being provided with a row of preferably four or more preferably equally spaced apertures, the other pair with two apertures. Locking bolts extend through the two apertures each of elongated frame members of one of the pairs and through two of the plurality of apertures in a row in each of the elongated frame members of the other pair.

Further choices among similar materials to construct the fastening device are possible; these choices will however be obvious to a skilled person within the art.

The invention can also be used in connection with fastening any other cargo that is not carried in a container, such as cargo that is palletized, bagged, baled, bundled, crated, etc. Further, the invention may be used for holding an anchor tight, a stay of a mast or like maritime situations in which there is a need of fastening and tightening two parts.

Even further the invention can be used in other situations that need fastening and tightening of two parts, e.g. electricity pylons, mobile communication antennas or similar high constructions that need to be secured to the ground.

It will also be understood that the invention is not limited to the particular examples described above but may be designed in a multitude of varieties within the scope of the invention as specified in the claims.

The invention claimed is:

1. A fastening device for lashing one or both of a load, and a container to a ship, comprising: a frame having at least one opening and a first means for connecting to either the ship or the container, a rod with corrugations, said rod being received in and movable through said at least one opening and including a second means for connecting to either the ship or the container, a holding device comprising at least two locking elements, each locking element including at least one surface comprising one or both of dents or grooves partly or totally corresponding to said corrugations, at least said frame or said holding device being provided with an at least partly tapered shape, and resilient structure urging said holding device towards said frame and thereby said locking elements towards each other.

2. A fastening device according to claim 1, wherein said fastening device includes a second rod with shock a absorbing spring.

3. A fastening device according to claim 1, wherein said frame comprises two longitudinal frame walls connected in an upper end by a transverse wall comprising a contact surface for said holding device, in a lower end by a second transverse wall comprising a contact surface for said shock absorbing spring and in between by a third transverse section comprising a contact surface for said spring forcing said holding device against said contact surface of said frame.

4. A fastening device according to claim 1, wherein the holding device includes release spring in between said surfaces comprising one or both of dents or grooves.

5. A fastening device according to claim 1, wherein one or both of the frame and said holding device comprises a substantially conical, frustoconical, triangular, pyramidal or tapered shape.

6. A fastening device according to claim 1, wherein said grooves of said surface are reversed frustoconical shaped, and said rod with corrugations comprises reversed frustoconical sections establishing the corrugations.

7. A fastening device according to claim 1, wherein said rod and said holding device comprise contact surfaces for handling tools.

8. A fastening device according to claim 1, wherein said resilient structure is a helical spring.

9. A method of use of a fastening device according to claim 1 comprising establishing a fastening connection between at least two locking elements in relation with fastening of cargo using the device of claim 1.

10. A method of establishing a fastening connection between a ship and a container, said method comprising the steps of: connecting a frame of said fastening device to the ship and a rod with corrugations to a lashing bar connected to the container, said rod being movable through and received in at least one opening of said frame, engaging said rod with corrugations by at least two locking elements of a holding device, at least said frame or said holding device comprising an at least partly tapered shape, and forcing said holding device against said frame by resilient structure and thereby urging said locking elements against each other.

11. A method according to claim 10, wherein said holding device or said rod with corrugations is released or tightened by a handling tool engaging with contact surfaces of said holding device or said rod with corrugations.

12. A method of use of a fastening device comprising establishing a fastening connection between at least two locking elements according to claim 10 in relation with fastening of cargo using locking elements of claim 10.

13. An assembly for securing a container to a ship comprising: a lashing bar connected at one end to the container and at the other end to a first part of a fastening device, the fastening device comprising a second part connected to the ship, the first part and second part being movable relative to one another in the longitudinal direction of a lashing bar; and said fastening device comprising locking elements that allow the first and second parts to move substantially unhindered towards one another whilst preventing the first and second parts from moving away from one another.

14. An assembly according to claim 13, wherein the first part comprises a corrugated surface, and the locking elements comprise at least one locking element provided with one or more protrusions for engaging the corrugated surface in the first part.

15. An assembly according to claim 14, wherein the engagement between the locking element and the corrugated surface of the first part is self-amplified and self-released upon a load that urges the first part and the second part away from one another.

16. An assembly according to claim 15, wherein the engagement between the locking element and the corrugated surface of the first part is self-releasing upon a load that urges the first part and the second part towards one another.

17. An assembly according to claim 15, wherein the self-amplification and self-release are caused by a wedge effect.

18. An assembly according to claim 15, wherein the self-amplification and self-release are caused by a lever effect.

19. An assembly according to claim 14, wherein the locking element is urged by the resilient structure to engage with the corrugated surface in the first part.

20. An assembly according to claim 14, wherein the locking element is connected to a release mechanism that moves the locking element against the bias of the resilient structure out of engagement with the corrugated surface of the first part.

21. An assembly according to claim 13, wherein the first part comprises a substantially cylindrical member and helical spring disposed coaxially over the cylindrical member, the helical spring engaging and locking the cylindrical member when a load that urges the first part and the second part away from one another is applied, and the helical spring disengaging the cylindrical member when a load that urges the first part and the second part towards one another is applied.

22. An assembly according to claim 21, wherein the cylindrical member is provided with a helical groove for engaging the helical spring.

23. An assembly according to claim 13, wherein the first part is a piston rod of a hydraulic cylinder with two chambers and the second part is the cylinder part of a hydraulic cylinder or vice versa, the two chambers of the hydraulic cylinder being in fluid communication through a conduit provided with a one way valve allowing fluid to flow between the two chambers when the first part and the second part are moving towards one another, whilst preventing fluid from flowing between the two chambers when the first part and the second part are moving away from another.

24. An assembly according to claim 23, wherein the chambers are in fluid communication via another conduit provided with an on-off valve.

* * * * *